US008257016B2

(12) United States Patent
Jahns

(10) Patent No.: US 8,257,016 B2
(45) Date of Patent: Sep. 4, 2012

(54) GAS TURBINE WITH A COMPRESSOR WITH SELF-HEALING ABRADABLE COATING

(75) Inventor: Ingo Jahns, Berlin (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 707 days.

(21) Appl. No.: 12/320,368

(22) Filed: Jan. 23, 2009

(65) Prior Publication Data

US 2009/0196730 A1 Aug. 6, 2009

(30) Foreign Application Priority Data

Jan. 23, 2008 (DE) ..... 10 2008 005 479
Jan. 23, 2008 (DE) ..... 10 2008 005 480
Jan. 23, 2008 (DE) ..... 10 2008 005 482

(51) Int. Cl.
*F04D 27/02* (2006.01)

(52) U.S. Cl. ..... 415/1; 415/174.3

(58) Field of Classification Search ..... 415/1, 173.4
See application file for complete search history.

(56) References Cited

U.S. PATENT DOCUMENTS

| | | | | |
|---|---|---|---|---|
| 4,222,706 | A | 9/1980 | Ayache et al. | |
| 4,269,903 | A * | 5/1981 | Clingman et al. | 428/591 |
| 4,318,666 | A | 3/1982 | Pask | |
| 4,329,113 | A | 5/1982 | Ayache et al. | |
| 4,666,371 | A | 5/1987 | Alderson | |
| 4,732,531 | A | 3/1988 | Minoda et al. | |
| 5,161,942 | A | 11/1992 | Chen et al. | |
| 5,586,859 | A * | 12/1996 | Nolcheff | 415/58.5 |
| 6,196,790 | B1 | 3/2001 | Sheridan et al. | |
| 6,425,736 | B1 | 7/2002 | McMahon et al. | |
| 7,086,233 | B2 | 8/2006 | Chehab et al. | |
| 7,246,993 | B2 | 7/2007 | Bolms et al. | |
| 7,699,581 | B2 | 4/2010 | Bayer et al. | |
| 7,766,611 | B2 | 8/2010 | Buchal et al. | |
| 7,775,766 | B2 | 8/2010 | Meier et al. | |
| 2005/0141990 | A1 * | 6/2005 | Guemmer | 415/134 |
| 2006/0153673 | A1 * | 7/2006 | Guemmer | 415/115 |
| 2009/0214824 | A1 * | 8/2009 | Daeubler et al. | 428/141 |
| 2011/0020560 | A1 | 1/2011 | Daeubler | |

FOREIGN PATENT DOCUMENTS

| | | |
|---|---|---|
| DE | 1061467 | 7/1959 |
| DE | 1913065 | 9/1970 |
| DE | 2833012 | 3/1979 |
| DE | 3209960 | 10/1982 |
| DE | 10337094 | 3/2005 |
| DE | 10360164 | 7/2005 |

(Continued)

OTHER PUBLICATIONS

German Search Report dated Mar. 18, 2009 from counterpart application.

(Continued)

*Primary Examiner* — Edward Wojciechowicz
(74) *Attorney, Agent, or Firm* — Timothy J. Klima; Shuttleworth & Ingersoll, PLC

(57) ABSTRACT

A gas turbine with a compressor includes at least one row of blades, with the blades having a free end each, with a self-healing abradable coating being provided adjacent to the free end of the blades on an annular casing area and/or an annular drum area.

20 Claims, 7 Drawing Sheets

FOREIGN PATENT DOCUMENTS

Figure 1:
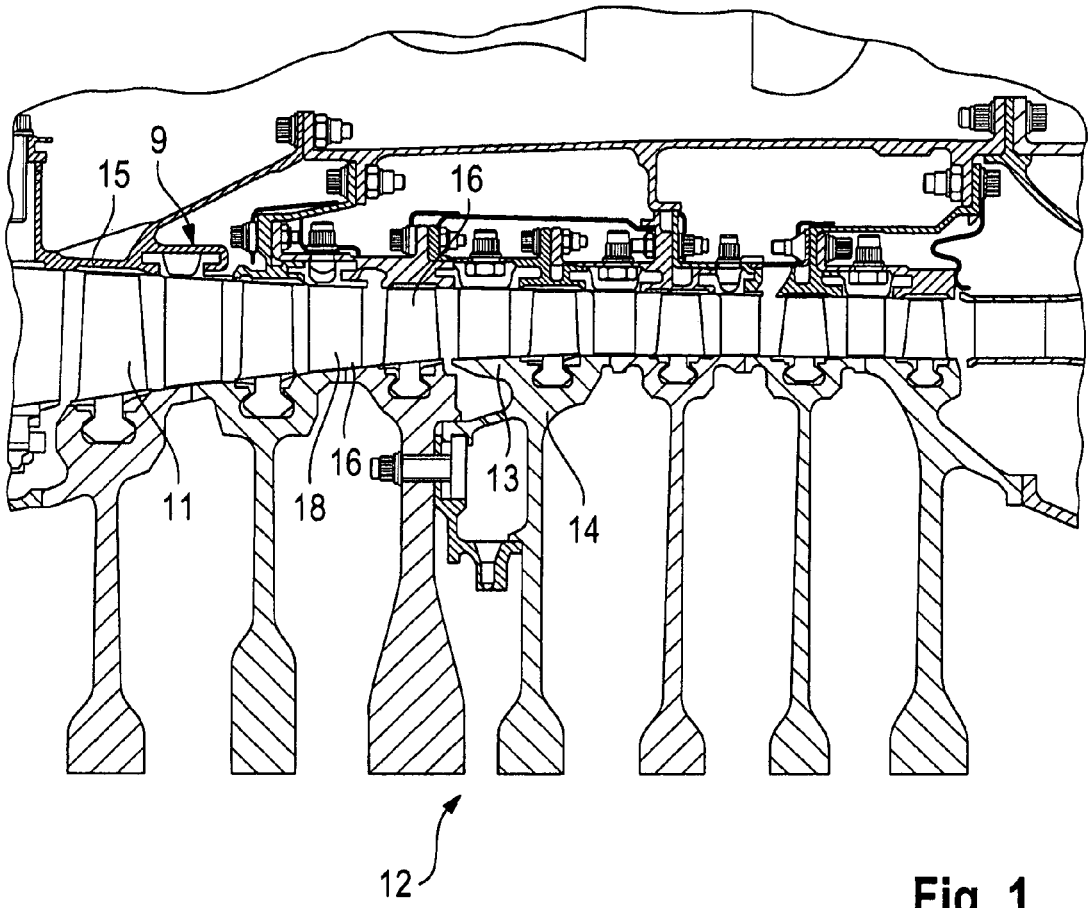
Fig. 1 (PRIOR ART)

| | | |
|---|---|---|
| DE | 10 2004 031255 | 1/2006 |
| DE | 69926203 | 1/2006 |
| DE | 60032843 | 6/2007 |
| DE | 102005058324 | 6/2007 |
| EP | 0 751 280 | 1/1997 |
| EP | 1245792 | 10/2002 |
| EP | 1717419 | 11/2006 |
| FR | 2438165 | 4/1980 |
| WO | 2005/114013 | 12/2005 |

OTHER PUBLICATIONS

German Search Report dated Mar. 17, 2009 from counterpart application.

German Search Report dated Apr. 22, 2009 from counterpart application.

European Search Report dated May 8, 2012 from counterpart application.

* cited by examiner

GAS TURBINE WITH A COMPRESSOR WITH SELF-HEALING ABRADABLE COATING

This application claims priority to German Patent Applications DE102008005479.8, DE102008005480.1, and DE102008005482.8, all filed Jan. 23, 2008, the entirety of which is incorporated by reference herein.

The present invention relates to a gas turbine. More particularly, the present invention relates to a gas turbine with a compressor including at least one row of blades, with the blades having a free end each, with an abradable coating being provided adjacent to the free ends of the blades on an annular casing area and/or an annular drum area.

Modern axial-flow compressors include a rotor with at least one rotor blade row and a casing. The distance between this rotor blade row and the casing should be as small as possible to avoid efficiency losses. Abradable coatings are provided in the casing to avoid damage in the case of collision with the rotor blades. If such collision occurs, areas of the abradable coating will be removed.

Various attempts are known to optimize the gap behavior. Efforts have often been made to adapt the thermal behavior of the casing to that of the rotor by airflows, for example in Specification U.S. Pat. No. 7,086,233. Other solutions aim at minimizing the gap by mechanical methods.

The running gap between the rotor blades and the casing is influenced by various factors:

1. Centrifugal loads exerted by the rotor and the blades,
2. Thermal movements, with the thermal response of the casing being mostly more rapid than that of the rotor,
3. Elastic expansions of the rotors and casings due to flight maneuvers,
4. Thermal expansions of rotors and casings upon shutdown of the engine.

The latter factor is difficult to control.

With conventional abradable coatings, the gap is set such that, under normal operating conditions, the rotor blades will not, or only to a minimum extent, rub this abradable coating. This ensures a small gap under normal operating conditions. Under extreme operating conditions, the rotor blade may rub these abradable coatings more heavily, removing material therefrom.

Disadvantageously, there is a considerable gap between the rotor blades and the abradable coating even under normal operating conditions, affecting surge limit and efficiency.

It is a broad aspect of the present invention to provide a gas turbine and a method for the blades to rub the coating which, while being simply designed and featuring high efficiency, avoids the disadvantages of the state of the art and shows a high degree of operational safety.

In a first aspect, the present invention accordingly provides a liquid for sealing, with the thickness of the film preferably being in the decimillimeter range only.

Preferably, materials are used which are readily available, for example water produced during combustion or oil required for lubrication.

According to the first aspect, the present invention provides an abradable coating which itself is permeable to liquid, thereby generating, on the surface of the abradable coating, a liquid film which acts towards the free blade ends and optimizes the rubbing characteristics of the blades. Thus, with the free blade ends mating with the liquid film, direct contact with the abradable coating is avoided under certain operating conditions.

The first aspect of the present invention can be described as a gas turbine with a compressor including at least one row of blades, with the blades having a free end each, with an abradable coating being provided adjacent to the free ends of the blades on an annular casing area, with the abradable coating being connected to a liquid supply device and with the abradable coating being provided with liquid passages. In an advantageous development, it is here provided that

- the liquid passages of the abradable coating are formed by pores of the material of the abradable coating, or the liquid passages of the abradable coating are formed by capillaries of the material of the abradable coating, and/or
- the abradable coating is arranged in an annular pocket of an abradable coating carrier provided with openings for passing the liquid and/or
- radially outside the abradable coating carrier an annular chamber is provided which is connected to the liquid supply device and into which the latter issues, and/or
- the liquid supply device is provided in the form of at least one feed tube and, further advantageously, the liquid supply device is operationally connected for the passage of water, or is operationally connected with an oil circuit for the passage of oil, and/or
- a liquid scavenge device is operationally connected to the abradable coating carrier, and/or
- the abradable coating is made of an electrically conductive material.

A method according to the first aspect of the present invention can be described as a method for the free end areas of the blades of a compressor of a gas turbine to rub the abradable coating, with the end areas being brought into contact with at least one, essentially annular abradable coating of an annular casing area, and with a liquid being applied to a surface of the abradable coating. In an advantageous embodiment, it is here provided that

- water is used as liquid or oil is used as liquid and/or
- an electrically conductive liquid is used, and/or
- a voltage is applied to the abradable coating.

In a second aspect, the present invention provides for the abradable coating being porous and suitable for the application of an air-hardening material.

The air-hardenable, or air-hardening, material is stored in an annular storage chamber or an annular storage reservoir. When the free ends of the compressor blades contact the surface of the annular casing area or the drum area, the air-hardening material is released and passed through the abradable coating. It travels through the abradable coating into the airflow of the annulus of the rotor (compressor) to harden thereupon.

The second aspect of the present invention can be described as a gas turbine with a compressor including at least one row of blades, with the blades having a free end each, with an abradable coating being provided adjacent to the free ends of the blades on an annular casing area, with the abradable coating being connected to a material supply device which contains air-hardening material, and with the abradable coating being provided with material passages. In an advantageous embodiment, it is here provided that

- the material passages of the abradable coating are formed by pores of the material of the abradable coating, or the material passages of the abradable coating are formed by minute tubes of the material of the abradable coating, and/or
- the abradable coating is arranged in an annular pocket of an abradable coating carrier provided with openings for passing the air-hardening material, and/or
- outside of the abradable coating carrier an annular storage reservoir is provided which is flexible and sealed airtight and from which the air-hardening material is fed into the abradable coating by application of pressure (air or also by centrifugal forces), and/or radially adjacent to the storage reservoirs an annular chamber pressurizable with compressed air is provided in the casing, with the chamber advantageously being separated from the storage reservoir by flexible sheeting, and/or the air-hardening material includes silicone.

A method according to the second aspect of the present invention can be described as a method for the free end areas of the blades of a compressor of a gas turbine to rub the abradable coating, with the end areas being brought into contact with at least one, essentially annular abradable coating of an annular casing area, and with an air-hardening material being applicable to a surface of the abradable coating. Here, it is advantageously provided that silicone and/or another hardenable matter is used as air-hardenable material.

In a third aspect, the present invention provides for the abradable coating being porous and suitable for the application of a liquid. A self-healing layer is produced on the surface of the abradable coating by evaporation of the liquid.

The gap between rotor blades and abradable coating is, in accordance with the present invention, set such that the top layer is not damaged under normal operating conditions. If the rotor blades rub the top layer during an extreme maneuver, the top layer will be removed and the basic structure of the abradable coating exposed. Now, the self-healing process will start. Liquid is evaporated until a substance dissolved in the liquid deposits on the damaged surface, thereby reclosing the damaged top layer.

The third aspect of the present invention can be described as a gas turbine with a compressor including at least one row of blades, with the blades having a free end each, with an abradable coating being provided adjacent to the free ends of the blades on an annular casing area, with the abradable coating being connected to a liquid supply device, with the abradable coating being provided with liquid passages, and with the blade-facing topmost layer of the abradable coating being of liquid-impermeable material. Here, it is advantageously provided that the liquid passages of the abradable coating are formed by pores of the material of the abradable coating, or the liquid passages of the abradable coating are formed by capillaries of the material of the abradable coating, and/or the topmost layer includes lime, and/or the abradable coating is arranged in an annular pocket of an abradable coating carrier provided with openings for passing the liquid, and/or radially outside the abradable coating carrier an annular chamber is provided which is connected to the liquid supply device and into which the latter issues, and/or the liquid supply device is provided in the form of at least one feed tube and, advantageously, the liquid supply device is operationally connected for the passage of water. In a further advantageous embodiment, the liquid supply device is operationally connected to an exhaust gas flow to enrich the water with carbon dioxide, with the liquid supply device advantageously being operationally connected to a stock of lime to enrich the water with calcium hydrogen carbonate, and/or a liquid scavenge device is operationally connected to the abradable coating carrier.

A method according to the third aspect of the present invention can be described as a method for the free end areas of the blades of a compressor of a gas turbine to rub the abradable coating, with the end areas being brought into contact with at least one, essentially annular abradable coating of an annular casing area, and with a blade-facing topmost layer being restored by evaporation of a liquid. Here it is advantageously provided that water is used as liquid, with the water advantageously being enriched with carbon dioxide via an exhaust gas flow, and with the water advantageously being enriched with calcium hydrogen carbonate via a stock of lime, and/or another matter dissolved or carried in the water is deposited by evaporation on the abradable coating area facing the blade end.

Figure 2:
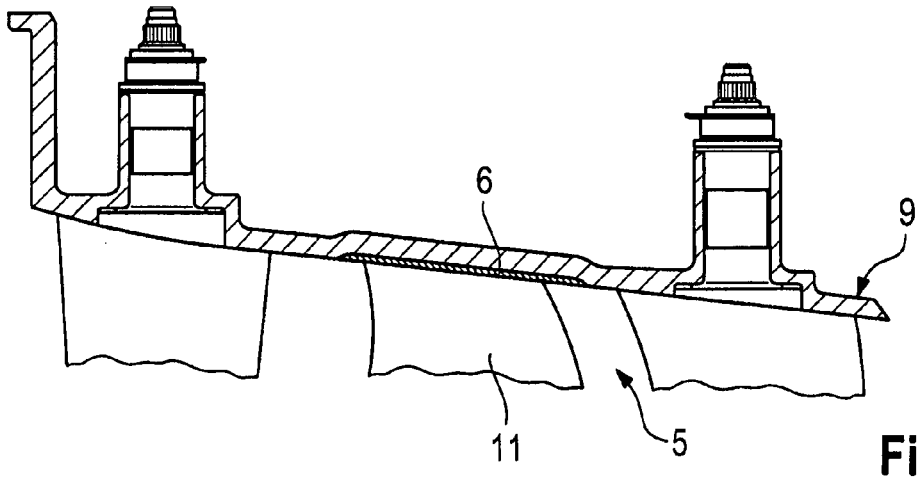
Fig. 2 (PRIOR ART)
Figure 3:
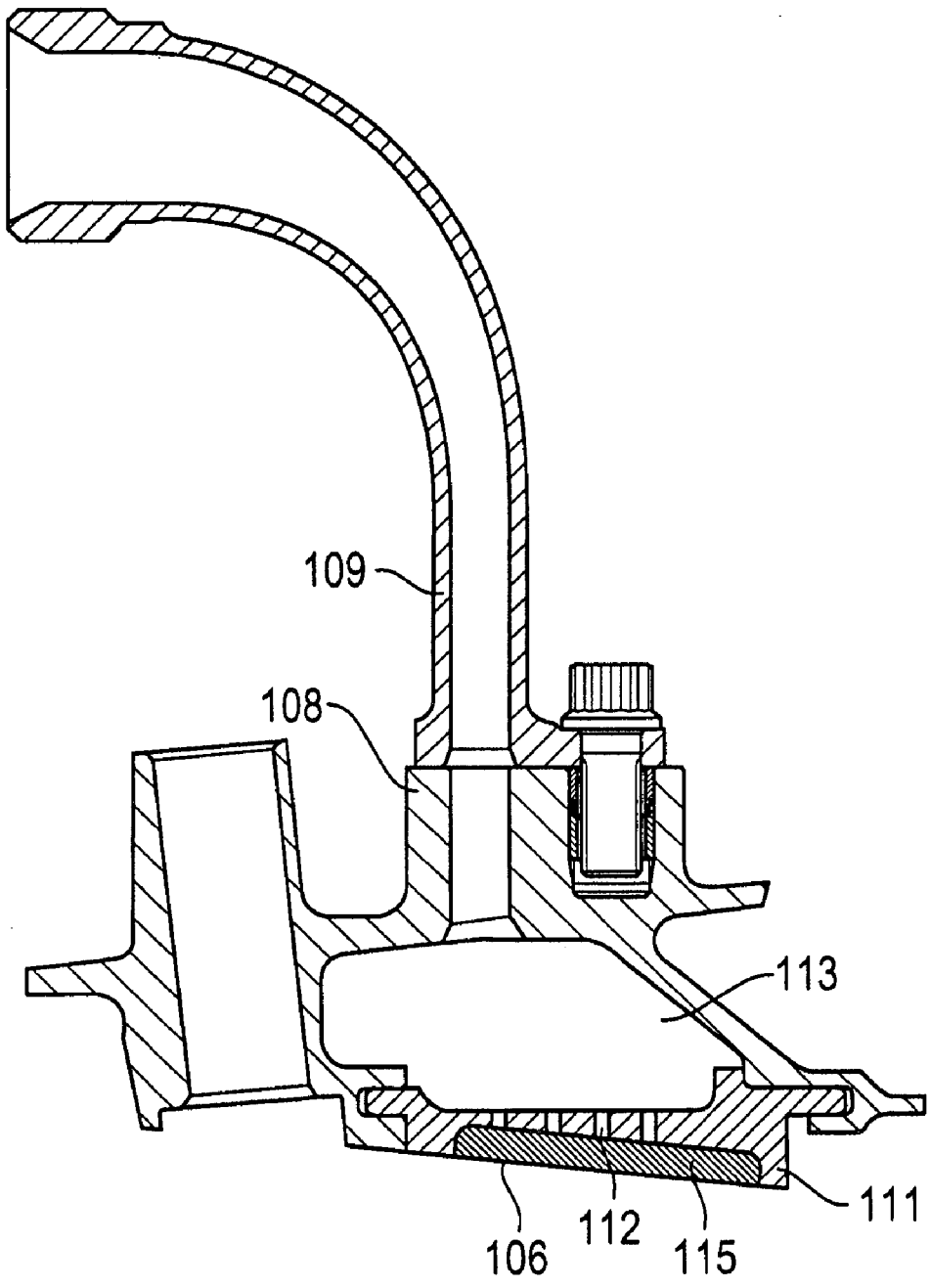
Figure 4:
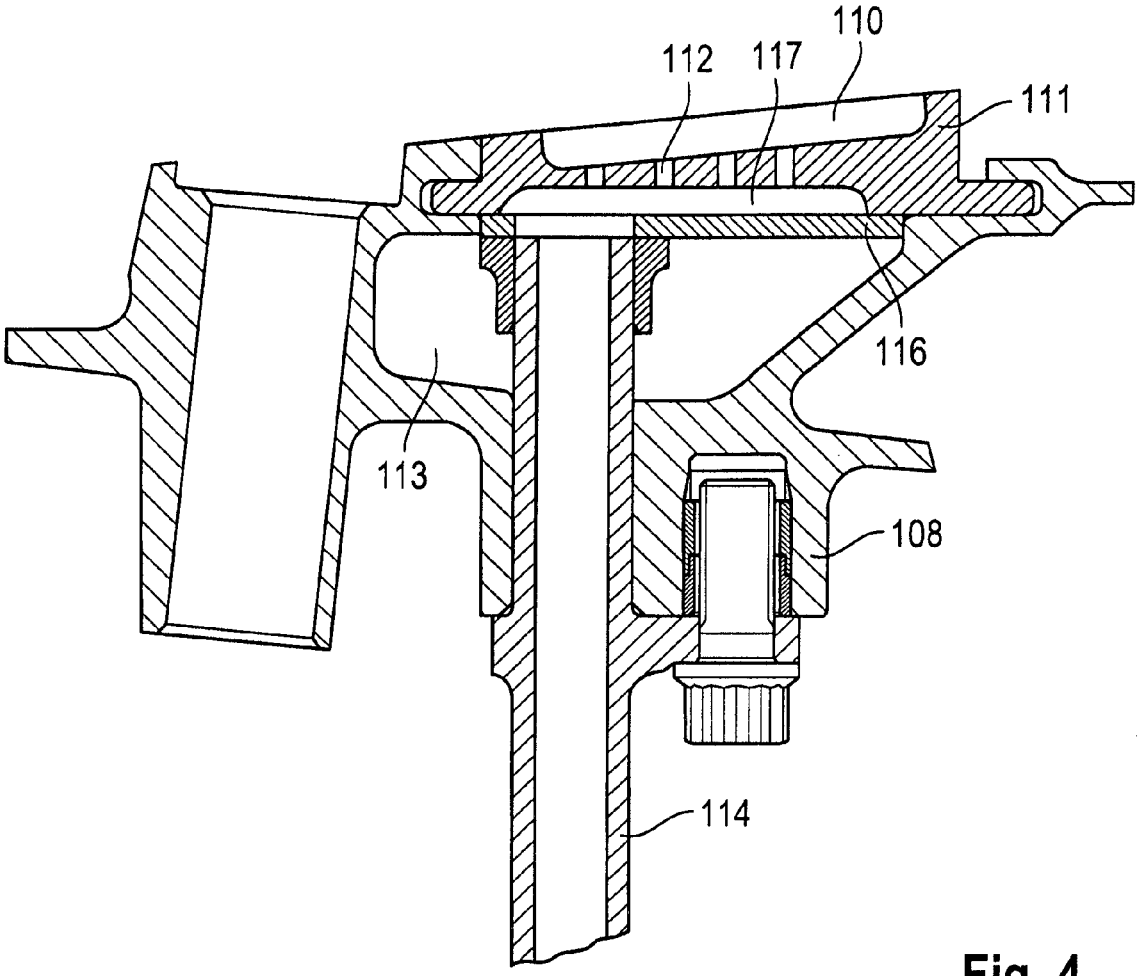
Figure 5:
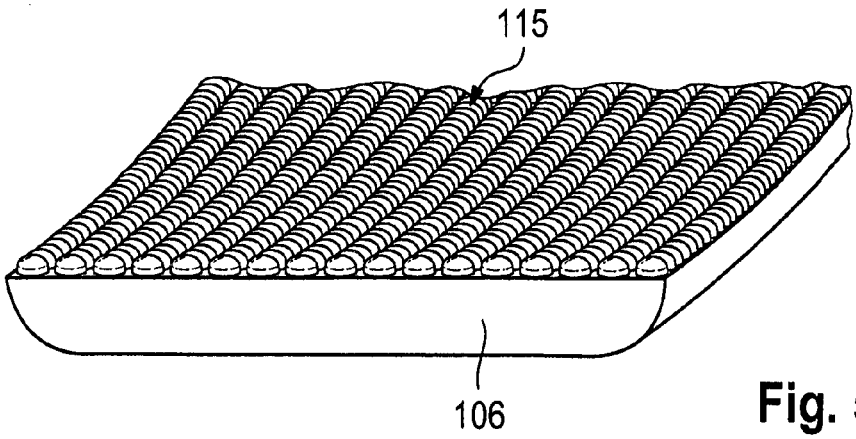
Figure 7:
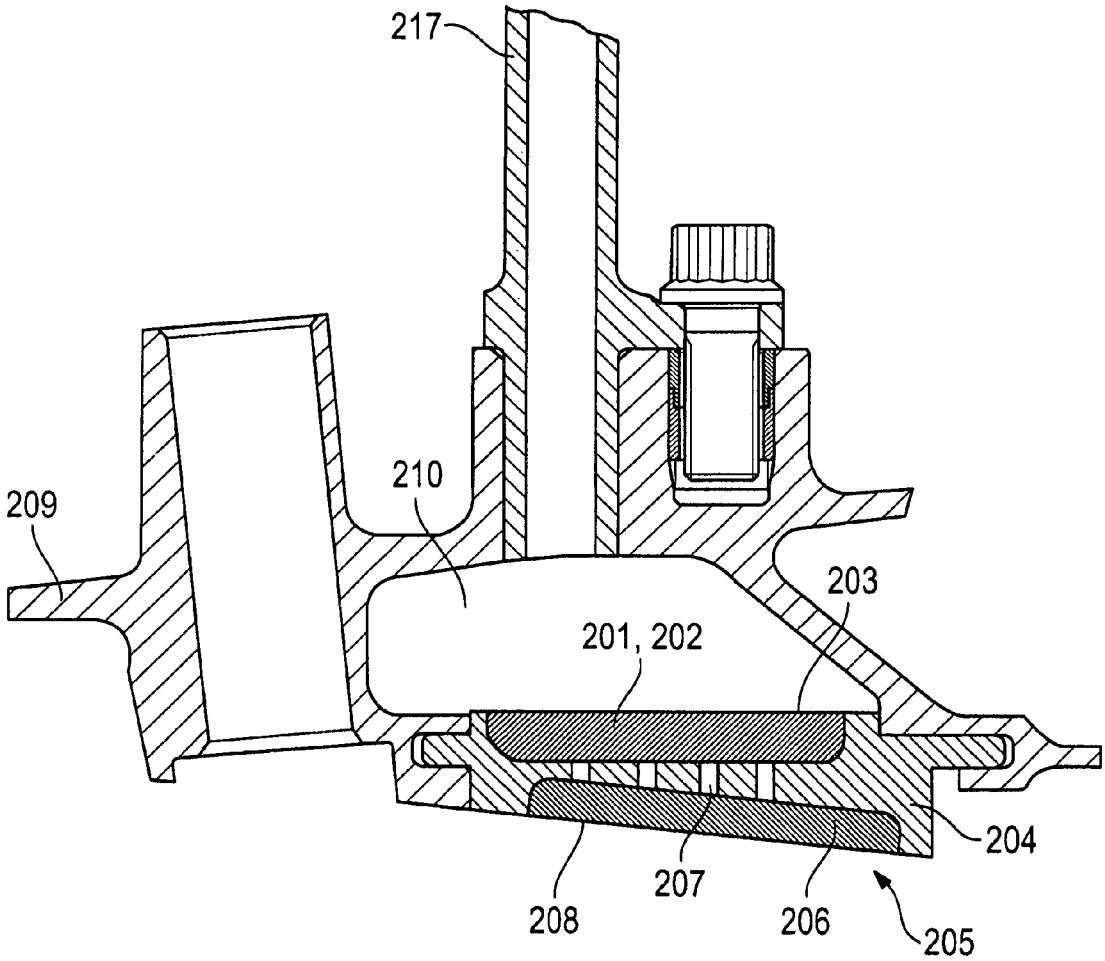
Figure 8:
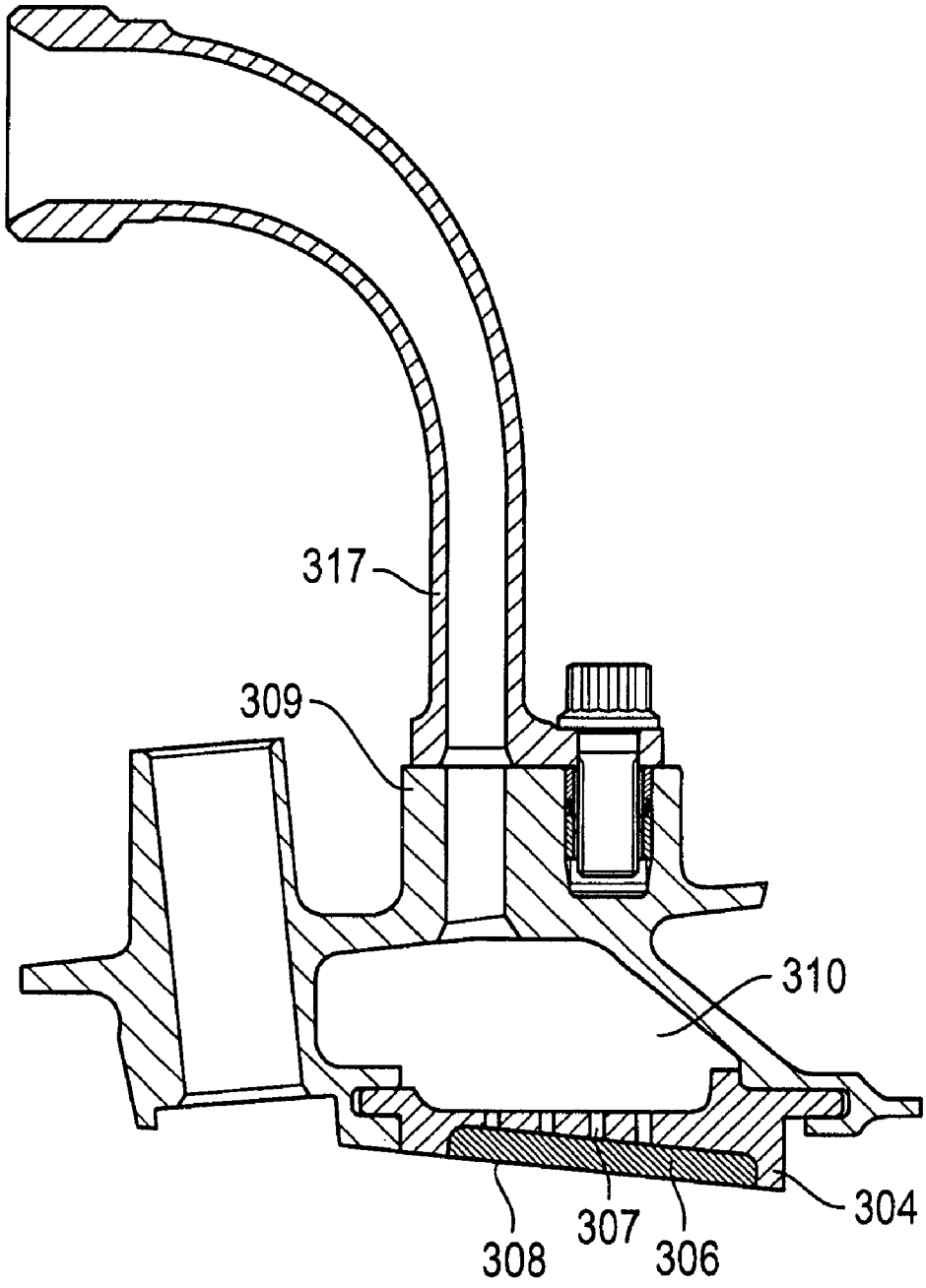
Figure 9:
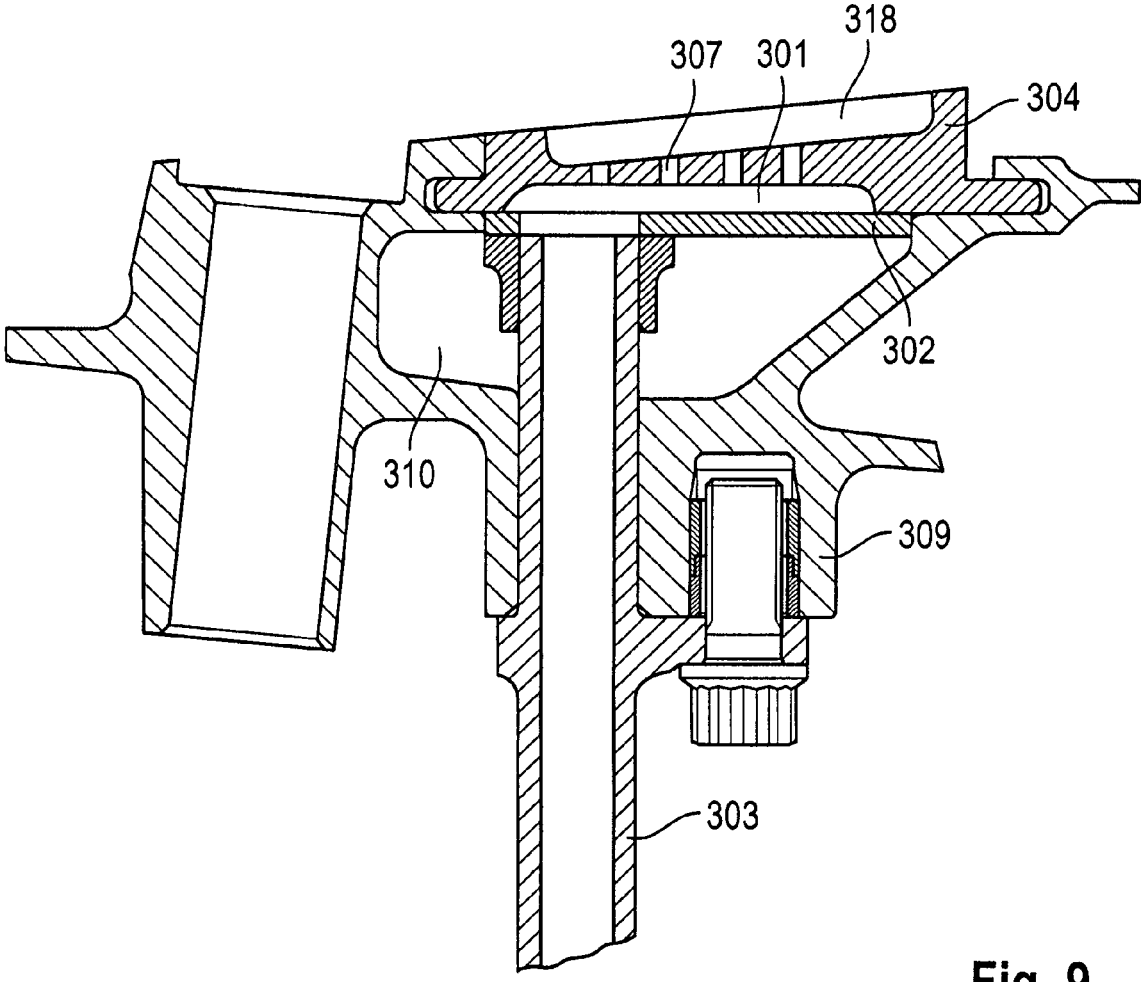

The present invention is more fully described in light of the accompanying drawings showing three embodiments. In the drawings, FIG. 1 is a partial representation of a compressor of a gas turbine in accordance with the state of art, with the gas turbine to be used according to the present invention, FIG. 2 is an enlarged detail view of an abradable coating in accordance with the state of art, FIG. 3 is a partial sectional view of the first embodiment of the present invention, FIG. 4 is a partial sectional view of a further aspect of the first embodiment of the present invention, FIG. 5 is an enlarged superficial view of the abradable coating in accordance with the first embodiment of the present invention, FIG. 6 is a partial representation of a compressor of a gas turbine in accordance with the first embodiment of the present invention, with the gas turbine to be used according to the present invention, FIG. 7 is an enlarged representation, analogically to FIG. 2, in accordance with a second embodiment of the present invention, FIG. 8 is an enlarged representation, analogically to FIG. 2, in accordance with a third embodiment of the present invention, and FIG. 9 is a partial sectional view in accordance with the third embodiment.

FIG. 1 shows, in partial view, a schematic arrangement of a compressor of a gas turbine to be used in accordance with the present invention. A rotor 14 (rotor drum) is here rotatably borne in an annular casing area 15, as shown in the state of the art. The rotor 14 has a drum area 13 which locates rows of rotor blades 11. Alternating rows of stator blades 18 are located on the annular casing area 15. Thus, a compressor 12 is formed, as known from the state of the art.

Free blade ends 16 of the rotor blades 11 and stator blades 18 mate, with minimum clearance, with the wall of a casing 9 or the rotor drum, respectively. In accordance with the present invention, an abradable coating 6 is here provided to enable the distance of the free blade ends to the surface of the casing 9 or the drum area 13, respectively, to be set by rubbing the coating.

Figure 6:
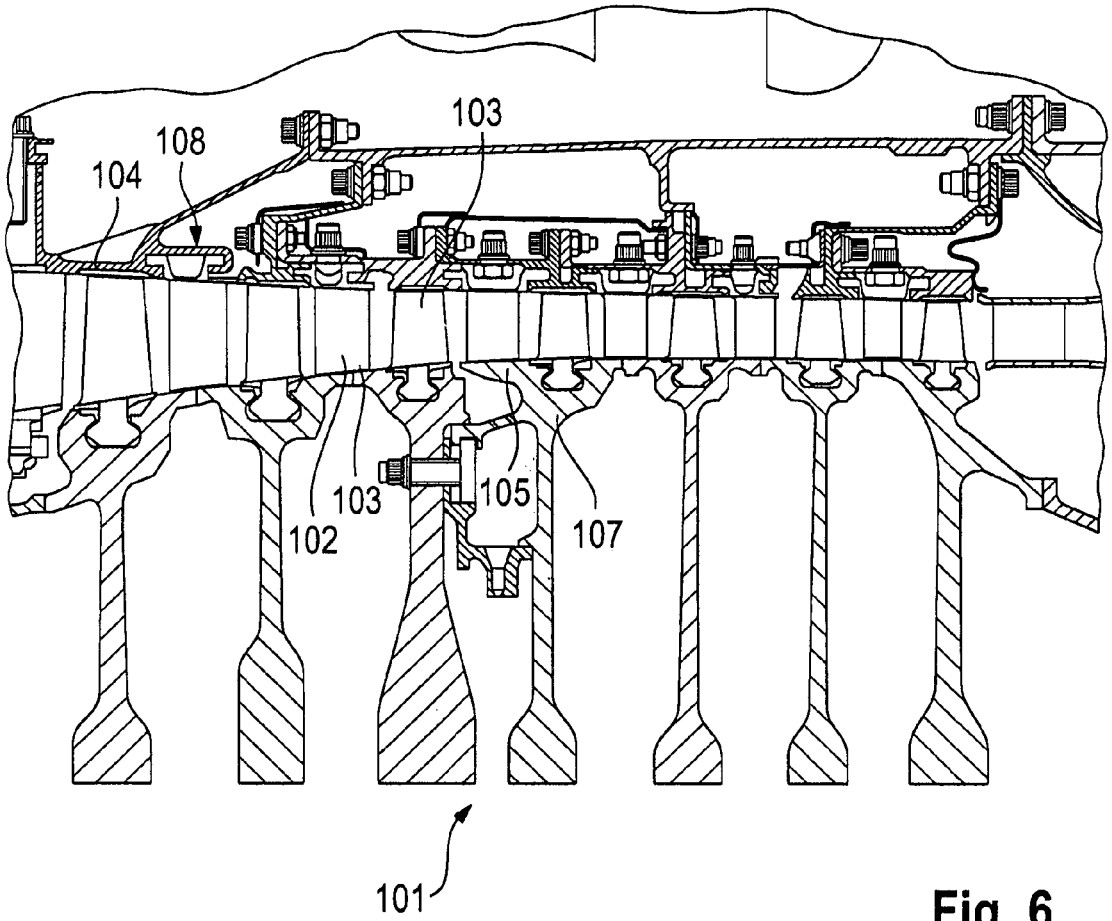

FIG. 6 shows, in partial view, a general arrangement of a first embodiment of a compressor of a gas turbine to be used in accordance with the present invention. A rotor (rotor drum) is here rotatably borne in an annular casing area, as shown in the state of the art. The rotor has a drum area which locates rows of rotor blades. Alternating rows of stator blades are located on the annular casing area. Thus, a compressor is formed, as known from the state of the art.

The liquid is supplied via at least one feed tube 109 (FIG. 3) on the casing 108. A chamber 113 provides for equal distribution of the liquid. An abradable coating carrier 111 also serves for sealing the chamber 113 against an annulus between adjacent blade rows. The abradable coating 106 is applied to the abradable coating carrier 111. The liquid gets to the abradable coating 106 via holes 112 in the abradable coating carrier 111.

In accordance with the present invention, the base layer of the abradable coating 106 preferably is a porous, hygroscopic basic material or has capillaries to enable the liquid to exit at the surface. For positive adherence of the liquid to the surface 115, the latter should have properties which enlarge its surface area, e.g. be rough or grainy (see FIG. 5). The liquid wets the surface 115 and forms a thin layer which can be rubbed by the rotor blades 102 (FIG. 6) under extreme operating conditions. The top layer of the abradable coating is, in accordance with the present invention, generated from the liquid. Molecules/atoms of the liquid are carried off by the airflow. Losses will consequently occur. The more viscous the liquid, the lower the losses. Due to the pressure in the annulus, it may be necessary to apply pressure to the liquid.

In order to avoid excessive accumulation of liquid in the bottom area of the engine, a scavenge device is preferably provided there (FIG. 4). Holes 112 in the abradable coating carrier 111 enable the excessive liquid to flow into a chamber 117. In the example shown, this chamber 117 is formed by the abradable coating carrier 111 and a cover plate 116 provided thereon. From there, the liquid is removed from the compressor via a scavenge tube 114.

In an advantageous development, the present invention provides for an electrically conductive liquid to be used (for example the atoms/molecules of the liquid are electrically conductive, or addition of electrically conductive matter to an otherwise non-conductive liquid). In this case, adherence of the particles to the surface 115 can be promoted by electrical forces. An electrically conductive layer is additionally provided in the abradable coating 106 or, respectively, the abradable coating 106 itself is an electrically conductive material. This electrically conductive material is covered with an insulating layer to avoid direct contact with the electrically conductive liquid. A voltage is now applied to the electrically conductive layer. The particles of the liquid are attracted by the voltage, thereby improving their adherence to the surface.

The gap behavior of an engine is difficult to control. The present invention enables the rotor blades to run into the liquid under extreme operating conditions. Other than a firm abradable coating, the liquid can be continually replaced, thereby enabling a uniform and optimized gap to be set.

In accordance with a second embodiment of the gas turbine (FIG. 7), an air-hardening (air hardenable) material 201, e.g. silicone, is preferably used. This is stored in a storage reservoir 202 behind the abradable coating carrier. The wall of the storage reservoir 202 is flexible, constructed, for example, of plastic sheeting 203.

An abradable coating 206 is applied to an abradable coating carrier 204. The air-hardening material (hardening substance) can reach the abradable coating 206 via holes/openings 207 in the abradable coating carrier 204.

In accordance with the present invention, the base layer of the abradable coating 206 is a porous basic material or has minute tubes. A topmost layer 208 of the abradable coating 206, which faces the free blade ends 216, is impermeable to air and protects the air hardening material from exposure to air in the compressor. By use of a feed tube 217, pressurized air can be fed through the casing 209 into a chamber 210 and exert a pressure on the wall of the storage reservoir 202.

In accordance with the present invention, a gap between the rotor blades 11 (FIG. 1) and the abradable coating 206 is set such that the top layer 208 (upper layer) is not damaged under normal operating conditions. If the top layer 208 is rubbed by the rotor blades 11 in an extreme maneuver, it will be worn off. As a result, the basic structure of the abradable coating 206 will be exposed.

The self-healing process provided by the present invention will now start. With a portion of the air impermeable layer worn through, exposing the permeable layer underneath, the air-hardening material (hardening substance), will be forced through the porous/permeable layer of the abradable coating 206 at this location of damage, come into contact with atmospheric oxygen of the compressor 12 and harden in the process, again sealing the air impermeable layer.

On a gas turbine according to the third embodiment (FIGS. 8 to 9), use is ideally made of substances which are available in operation. As a liquid, water is preferably used. During combustion of fuel, carbon dioxide and water are released. The exhaust gases can be tapped from the exhaust gas flow and the water brought to condensation.

However, the substances used according to the present invention can also be carried as stock or obtained from the ambient air.

In accordance with the present invention, carbon dioxide is dissolved in water, producing carbonic acid. The colder the water and the higher the pressure, the more carbon dioxide is soluble. Accordingly, the present invention also provides for setting up a circuit with pump and cooling of the water.

Lime is required in the subsequent process. In accordance with the present invention, the weakly carbonic-acidic water is fed over the lime, thereby converting the lime to water-soluble calcium hydrogen carbonate. The water, which contains calcium hydrogen carbonate, is now fed via a feed tube 317 on the casing 309. A chamber 310 provides for even distribution of the liquid. The abradable coating carrier 304 is here also used to the seal the chamber 310 against the annulus 5 (FIG. 2). The abradable coating 306 is applied to the abradable coating carrier 304. The liquid travels to the abradable coating 306 via openings 307 in the abradable coating carrier 304. In accordance with the present invention, the base layer of the abradable coating 306 is of porous basic material or has minute tubes, enabling it to be passed by the water, which contains calcium hydrogen carbonate. The topmost layer 308 of the abradable coating 306 is of a water-impermeable covering coat.

In accordance with the present invention, the gap between the rotor blades 11 and the abradable coating 306 is set such that the top layer 308 is not damaged under normal operating conditions. If the top layer 308 is rubbed by the rotor blades 11 in an extreme maneuver, it will be worn off and the basic structure of the abradable coating 306 exposed. The self-healing process will now start. Water will be evaporated until a layer of lime deposits on the damaged surface, thereby reclosing the damaged top layer 308.

In accordance with the present invention, the base layer of the abradable coating 306 is of porous basic material or has minute tubes (capillaries).

In order to avoid excessive accumulation of liquid in the bottom area of the engine, a scavenge device is preferably provided there (FIG. 9). Via holes 307 in the abradable coating carrier 304, the excessive liquid can get into a chamber 301. In the example shown, this chamber 301 is formed by the abradable coating carrier 304 and a cover plate 302 provided thereon. From there, the liquid is removed from the compressor via a scavenge tube 303.

The gap behavior of an engine is difficult to control. The present invention provides for self-regeneration of the abradable coating and at least partial restoration of the running gap.

LIST OF REFERENCE NUMERALS

5 Annulus of the rotor
11 Rotor blades

12 Compressor
13 Drum area
14 Rotor/drum
15 Annular casing area
16 Free blade end
18 Stator blades
101 Compressor
102 Blade
103 Free blade end
104 Casing area
105 Drum area
106 Abradable coating
107 Rotor/drum
108 Casing
109 Feed tube/liquid supply device
110 Pocket
111 Abradable coating carrier
112 Hole
113 Annular chamber
114 Scavenge tube/liquid scavenge device
115 Surface of the abradable coating 6
116 Cover plate
117 Chamber
201 Air-hardening/air-hardenable material
202 Storage reservoir/material supply device
203 Flexible sheeting/plastic sheeting
204, 304 Abradable coating carrier
6, 206, 306 Abradable coating
207, 307 Hole/opening
208, 308 Topmost layer/top layer
209, 309 Casing
210, 310 Chamber
217, 317 Feed tube
301 Chamber
302 Cover plate
303 Scavenge tube/liquid scavenge device
318 Pocket

What is claimed is:

1. A gas turbine compressor, comprising:

at least one row of blades, the blades having a free end each, an abradable coating provided on an annular casing area and having an exposed surface adjacent and facing the free ends of the blade, a thin layer of liquid positioned on the exposed surface of the abradable coating to be rubbed by the free ends of the rotor blades under certain operating conditions, wherein the abradable coating includes liquid passages positioned therein for connection to a liquid supply device for supplying liquid from the liquid supply device through the abradable coating to the exposed surface to form the thin layer of liquid.

2. A gas turbine compressor, comprising:

at least one row of blades, the blades having a free end each, an abradable coating provided on an annular casing area and having an air impermeable exposed surface adjacent and facing the free ends of the blades, wherein the abradable coating includes material passages positioned therein for connection to a pressurized material supply device for supplying air-hardening material from the material supply device through the abradable coating to the exposed surface upon a breach of the air impermeable exposed surface for self sealing the breach in the air impermeable surface by hardening upon contact with air in the compressor through the breach.

3. A gas turbine compressor, comprising:

at least one row of blades, with the blades having a free end each, an abradable coating provided on an annular casing area adjacent and facingto the free ends of the blades, the abradable coating further including a blade-facing topmost layer of a liquid-impermeable material, wherein the abradable coating includes liquid passages positioned therein for connection to a liquid supply device for supplying a sealant-containing liquid from the liquid supply device through the abradable coating to a breach of the liquid-impermeable layer for self sealing the breach in the liquid-impermeable surface by depositing the sealant in the breach.

4. The gas turbine compressor of claim 1, wherein the liquid passages of the abradable coating are formed by pores of a porous material of the abradable coating.

5. The gas turbine compressor of claim 1, wherein the supplied liquid is one of water and oil.

6. The gas turbine compressor of claim 2, wherein the air-hardening material includes silicone.

7. The gas turbine compressor of claim 2, and further comprising an abradable coating carrier to which the abradable coating is attached, an annular storage reservoir positioned outside of the abradable coating carrier which is flexible and sealed air-tight and from which the air-hardening material is fed into the abradable coating by application of pressure.

8. The gas turbine compressor of claim 4, and further comprising an abradable coating carrier to which the abradable coating is attached, an annular storage reservoir positioned outside of the abradable coating carrier which is flexible and sealed air-tight and from which the air-hardening material is fed into the abradable coating by application of pressure.

9. The gas turbine compressor of claim 1, wherein the liquid passages of the abradable coating are formed by capillaries passing through a material of the abradable coating.

10. The gas turbine compressor of claim 1, and further comprising a scavenging system positioned on a bottom area of the engine for scavenging liquid flowing from the abradable coating.

11. The gas turbine compressor of claim 10, wherein the scavenging system includes holes positioned in the abradable coating for flowing liquid accumulated on the bottom area of the engine to a scavenging passage exiting the compressor.

12. The gas turbine compressor of claim 1, wherein the liquid is electrically conductive and the abradable coating includes an electrically conductive portion having an electrical differential with the electrically conductive liquid for adhering the electrically conductive liquid to the exposed surface.

13. The gas turbine compressor of claim 12, wherein the abradable coating includes an insulating portion insulating the electrically conductive portion to prevent direct contact with the electrically conductive liquid.

14. The gas turbine compressor of claim 2, wherein the material passages of the abradable coating are formed by pores of a porous material of the abradable coating.

15. The gas turbine compressor of claim 2, wherein the material passages of the abradable coating are formed by capillaries passing through a material of the abradable coating.

16. The gas turbine compressor of claim 3, wherein the liquid passages of the abradable coating are formed by pores of a porous material of the abradable coating.

17. The gas turbine compressor of claim 3, wherein the liquid passages of the abradable coating are formed by capillaries passing through a material of the abradable coating.

18. The gas turbine compressor of claim 3, wherein the liquid is water and the sealant is calcium hydrogen carbonate carried by the water, which deposits a sealing layer of lime at the breach upon evaporation of the water.

19. The gas turbine compressor of claim 3, and further comprising a scavenging system positioned on a bottom area of the engine for scavenging liquid flowing from the abradable coating.

20. The gas turbine compressor of claim 19, wherein the scavenging system includes holes positioned in the abradable coating for flowing liquid accumulated on the bottom area of the engine to a scavenging passage exiting the compressor.

* * * * *